United States Patent [19]

Chiesa, Jr.

[11] 4,149,599

[45] * Apr. 17, 1979

[54] FIGHTING FIRE

[75] Inventor: Peter J. Chiesa, Jr., Coatesville, Pa.

[73] Assignee: Philadelphia Suburban Corporation, Bryn Mawr, Pa.

[ * ] Notice: The portion of the term of this patent subsequent to Nov. 29, 1994, has been disclaimed.

[21] Appl. No.: 808,462

[22] Filed: Jun. 21, 1977

Related U.S. Application Data

[63] Continuation-in-part of Ser. No. 670,252, Mar. 25, 1976, Pat. No. 4,060,489, Ser. No. 557,757, Mar. 12, 1975, Pat. No. 4,060,132, and Ser. No. 525,175, Nov. 19, 1974, Pat. No. 4,038,195, each is a continuation-in-part of Ser. No. 369,584, Jun. 13, 1973, Pat. No. 3,957,659, said Ser. No. 557,757, Ser. No. 525,175, and Ser. No. 369,584, each is a continuation-in-part of Ser. No. 307,479, Nov. 17, 1972, abandoned, said Ser. No. 525,175, Ser. No. 369,584, and Ser. No. 307,479, each is a continuation-in-part of Ser. No. 254,404, May 18, 1972, Pat. No. 3,849,315, said Ser. No. 369,584, Ser. No. 307,479, and Ser. No. 254,404, each is a continuation-in-part of Ser. No. 131,763, Apr. 6, 1971, abandoned.

[51] Int. Cl.[2] ..... A62D 1/00

[52] U.S. Cl. ..... 169/47; 169/46; 252/3; 252/6.5; 252/8.05; 252/307; 252/316; 536/1

[58] Field of Search ..... 169/47, 46; 252/3, 8.05, 252/6.5, 307, 316; 260/209 R, 210 R

[56] References Cited

U.S. PATENT DOCUMENTS

| | | | |
|---|---|---|---|
| 3,849,315 | 11/1974 | Chiesa, Jr. | 252/8.05 |
| 3,915,800 | 10/1975 | Kang et al. | 195/31 P |
| 3,957,657 | 5/1976 | Chiesa, Jr. | 252/8.05 |
| 3,957,658 | 5/1976 | Chiesa, Jr. et al. | 252/8.05 |
| 3,984,334 | 10/1976 | Hopper | 252/8.05 |
| 4,060,132 | 11/1977 | Chiesa, Jr. | 169/47 |
| 4,060,489 | 11/1977 | Chiesa, Jr. | 252/3 |
| 4,089,804 | 5/1978 | Falk | 252/356 |

OTHER PUBLICATIONS

Howard, R. D., Research Disclosure, No. 122, pp. 47–48 (Jun. 1974).

*Primary Examiner*—Benjamin R. Padgett
*Assistant Examiner*—T. S. Gron
*Attorney, Agent, or Firm*—Connolly and Hutz

[57] ABSTRACT

Fire-fighting foam effecting against burning hydrophilic or polar liquids like lower alcohols, ketones, etc. is made from concentrate containing thixotropic thickener dissolved in large amount, yet has a tolerable viscosity particularly when stirred. Heteropolysaccharide-7 or chain-shortened modifications of it are suitable for this purpose. The concentrate can also be made suitable for fighting fires on hydrophobic liquids by adding surfactants that cause aqueous film formation over such liquids.

5 Claims, No Drawings

FIGHTING FIRE

This application is a continuation-in-part of applications Ser. No. 670,252 filed Mar. 25, 1976 (U.S. Pat. No. 4,060,489 granted Nov. 29, 1977), Ser. No. 557,757 filed Mar. 12, 1975 (U.S. Pat. No. 4,060,132 granted Nov. 29, 1977) and Ser. No. 525,175 filed Nov. 19, 1974 (U.S. Patent No. 4,038,195 granted July 26, 1977), each of which is in turn a continuation-in-part of prior application Ser. No. 369,584 filed June 13, 1973 (U.S Pat. No. 3,957,659 granted May 18, 1976). Applications Ser. Nos. 557,757, 525,175 and 369,584 are also continuations-in-part of earlier application Ser. No. 307,479 filed Nov. 17, 1972 (subsequently abandoned); while applications Ser. Nos. 525,175, 369,584 and 307,479 are each continuations-in-part of still earlier application Ser. No. 254,404 filed May 18, 1972 (U.S. Pat. No. 3,849,315 granted Nov. 19, 1974); and applications Ser. Nos. 369,584, 307,479 and 254,404 are each continuations-in-part of parent application Ser. No. 131,763 filed Apr. 6, 1971 (subsequently abandoned).

The present invention relates primarily to the fighting of fires on hydrophilic liquids.

Among the objects of the present invention is the provision of novel compositions with which to fight such fires, as well as novel fire-fighting processes that make use of such compositions.

These as well as further objects of the present invention will be more fully expounded in the following description of several of its exemplifications.

The fighting of fires on hydrophilic liquids such as isopropyl alcohol, acetone, and the like, has heretofore not reached the advanced state that has been attained in the art of fighting fires on hydrophobic liquids. Aqueous foams are considered the most desirable materials for fighting fires on large bodies of flammable liquids, such as in storage tanks, but hydrophilic liquids have an undesirable effect on such foams.

Applications Ser. Nos. 670,252 and 557,757 show that the presence of a thixotropic polysaccharide in dissolved condition in the aqueous liquid from which the foam is prepared, causes the foam to gel and become a bubble-containing mat when it contacts the hydrophilic liquid. Such mat floats on the burning liquid and protects the foam above it so that the fire is fairly rapidly extinguished.

Because the foams are generated by foaming an aqueous concentrate that is diluted with many times its volume of water, the concentration of the thixotropic polysaccharide in the diluted solution is quite small so that it is difficult to develop a very good, stable mat formation. Moreover it is not too practical to merely dissolve a very high concentration of the thixotropic polysaccharide in the aqueous concentrate, inasmuch as this produces a concentrate that is too stiff a gel to be rapidly dilute to foaming dilution or to be suitable for use with the proportioning foamers that have been developed. As a result special solvents have been used to make the concentrates, or thickeners have been incorporated in such a way that the concentrates themselves are not too stable.

According to the present invention very desirable fire-fighting concentrates are in the form of solutions essentially in water, which solutions have dissolved in them a thixotropic polysaccharide thickener that increases their Brookfield spindle 4 viscosity at 20° C. to not over about 3,000 centipoises at 60 rpm spindle speed, and the concentration of the thickener in the concentrates being at least about 1% by weight.

A particularly desirable thixotropic polysaccharide is heteropolysaccharide-7 described in U.S. Pat. No. 3,915,800, as well as somewhat degraded forms of heteropolysaccharide-7. Among other advantages these polysaccharides yield more effective foams when such foams are made with the help of sea water, as compared to fresh water.

Some working examples illustrate the present invention.

EXAMPLE 1

The following ingredients are combined:

| | |
|---|---|
| Water | 9,240 ml. |
| Chlorinated metaxylenol | 3.6 g. |
| Urea | 93 g. |
| 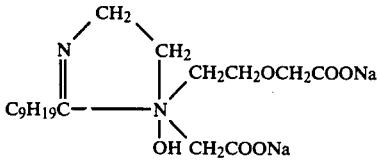 | |
| (30% in water) | 357 ml. |
| Heteropolysaccharide-7 | 122 g. |
| 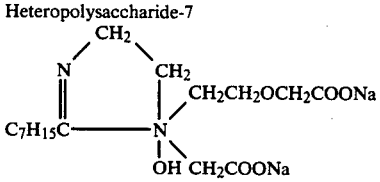 | |
| (30% in water) | 675 ml. |
| 30% aqueous solution of equimolecular mixture of sodium decylsulfate and sodium octylsulfate | 795 ml. |
| Monobutyl ether of diethylene glycol | 300 ml. |
| 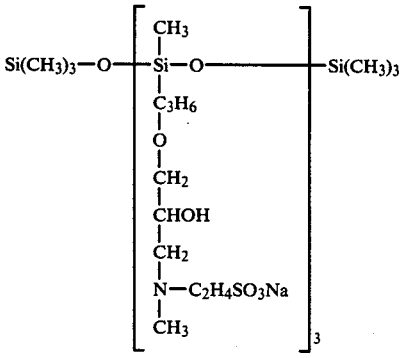 | |
| (40 weight percent in 1:1 isopropyl-water mixture by volume) | 213 ml. |
| $(CF_3)_2CF(CF_2)_nCOO^- {}^+NH_3C_2H_5$ where 20% of the n is 2, 30% of the n is 4, 30% of the n is 6, and 20% of the n is 8 | 102 g. |
| $MgSO_4$ | 204 g. |

The heterpolysaccharide-7 is difficult to dissolve directly in water in the above-specified amount, and it is preferred to begin by mixing together the first five ingredients, using only 12 ml. of the fourth ingredient (the $C_9$-substituted imidazoline) and adding the fifth in small portions with stirring, followed by pumping this pre-mix through a recirculating pump until smooth. The remaining ingredients are then added and the resulting mixture thoroughly mixed. Its pH should be about 7.1 to 8, and if necessary it is adjusted to that pH with acetic acid or ammonia. Upon completion of the stirring associated with the mixing, the product rapidly gels, but the gel is easily liquefied by a little agitation. With a bit of stirring it flows fairly easily. Uner the influence of a suction of several inches of mercury produced at the intake of a venturi jet, the gel flows smoothly up into such a suction intake.

When the foregoing concentrate is diluted with ten times its volume of water it is readily foamed with air to produce a very effective fire-fighting foam having an expansion of 6 to 8. When foamed with the apparatus of U.S. Pat. No. 2,868,301 the foam can be projected a substantial distance. Projected onto a burning liquid as hydrophilic or as polar as ethanol or acetone, the majority of foam thus applied is not broken, but some forms a gel-like mat that does not dissolve in such liquid rapidly enough to significantly diminish the spreading of the projected foam over the burning surface and the extinguishing of the fire by the foam. The formation of the mat involves gelation of the liquid contained in the foam and loss of water from the gelled liquid to the hydrophilic liquid through syneresis, and takes place so rapidly that the foam bubbles are trapped in the mat causing it to float on the hydrophilic liquid. This action takes place with about equal effectiveness when the diluting water is tap water or sea water or any combination of these two waters, and resulting diluates have about the same fire-fighting effectiveness.

Also when used to fight fires on hydrophobic liquids, the foregoing foam shows about the same good results as the foams of British Pat. No. 1,381,953 (the counterpart of parent application Ser. No. 131,763), and Ser. No. 254,404.

EXAMPLE 2

The formulation of Example 1 is modified in two respects. Instead of the 122 grams of heteropolysaccharide-7, there is added 138 grams of a degraded form of that polysaccharide, and instead of 102 grams of the ethylamine salt of the perfluorinated mixed acids, 100 grams of the free mixed acids $CF_3(CH_2)_mCOOH$ are used, where 40% of the m is 4, 35% of the m is 6, and 25% of the m is 8.

The degraded form of the polysacchride is prepared by adding a little HCl to the fermentation broth in which it is formed to bring its pH to 6.5, and then heating the acidified broth to 90° C. for thirty minutes. The degraded product is then recovered by the same technique used to recover the undegraded material.

Other hydrolysis techniques can be used to degrade the fermentation product if desired. Alternatively degradation can be effected by heat alone or by oxidative attack. Thus a one-hour boiling of the fermentation broth causes degradation, or the fermentation broth can be treated with 1/20 its volume of 30% $H_2O_2$ at 70° C. for 30 minutes, and a similar degradation can be effected with 1/10 its volume of acidified 2% potassium permanganate at 50° C. The degradation is not major and the degraded product is still quite insoluble in lower alcohols so that the recovery technique does not have to be modified. It is estimated that the degrading step shortens the polymer chains about twenty to thirty percent and has no other significant effect. The viscosity of a 1% aqueous solution of the polymer at low shear is generally reduced about 1/3, and this is the important result that is desired.

Because of the viscosity reduction the formulation of Example 2 contains more of the polysacchride and when diluted and foamed it is somewhat more effective in extinguishing fires on hydrophilic liquids. Thus when a typical concentrate of Example 2 has its viscosity measured with a Brookfield LVF viscometer using a No. 4 spindle, it gives the following readings at the designated spindle speeds:

| Spindle Speed in Revolutions per Minute | Viscosity in Centipoises |
|---|---|
| 0.3 | 142,000 |
| 0.6 | 95,000 |
| 1.5 | 53,600 |
| 3.0 | 32,000 |
| 6.0 | 17,700 |
| 12.0 | 9,450 |
| 30.0 | 4,200 |
| 60.0 | 2,330 |

Because the 60 rpm viscosity is below 3000 centipoises, such a concentrate is well suited for use with standard proportioning foamers. Because of the high content of the polysacchride, over 1.1% by weight of the concentrate, it can be diluted with more than 10 times its volume of water and still do a very good job of extinguishing fires. A typical fire test gives the following results on a burning batch of 60 gallons 99% isopropyl alcohol in a round pan providing a 40 square foot surface.

| | |
|---|---|
| Preburn time | 3 minutes |
| Dilution | with 16 ⅔ its volume of tap water |
| Appilication rate | 0.15 gallons of diluate per minute per square foot of surface |
| Expansion | 8.8 |
| Control | 2 minutes 20 seconds |
| Extinguishment | 2 minutes 50 seconds |
| Sealability (the application of the foam is continued for 1 minute after extinguishment) | 11 minutes 30 seconds |

A feature of heteropolysaccharide-7 as well as of the thixotropic polysaccharides into which it can be degraded, is that they are more effectively in extinguishing fires on hydrophilic liquids when they are used with sea water, as compared to their use with fresh water. This appears to be largely due to the presence of magnesium ions in sea water, and the addition of magnesium ions in the foregoing formulations in a proportion of at least about 1/6 the weight of the polysaccharide, shortens their fire extinguishing times when they are diluted with fresh water. It has no significant effect on the fire extinguishing when sea water is the diluent.

Increasing the magnesium ion content to about 1/3 the weight of the polysaccharide heightens the improvement, but further increases in magnesium ion content do not further add significantly to the effectiveness.

Adding too much magnesium ion can also produce problems such as the precipitation of magnesium compound when the concentrate is subjected to very low temperatures. Such precipitation could interfere with the use of the concentrate in standard proportioning foamers in extremely cold weather. Magnesium sulfate in a proportion of about 1.3 to about 1.7 times the weight of the polysaccharide is a preferred choice and gives magnesium ions in a proportion of about 1/4 to about 1/3 the weight of the polysaccharide. However, magnesium chloride, nitrate, and/or acetate can be substituted for some or all of the magnesium sulfate, if desired. Other metallic ions such as of calcium, chromium and the others listed in U.S. Pat. No. 3,915,800 (Table VII) can be substituted for the magnesium but are not as good at equalizing the effects of sea water and fresh water dilution.

The urea in the foregoing examples can be reduced in amount or entirely eliminated, inasmuch as its principal effect is to speed up the solution of the polysaccharide in the water. For the degraded forms of heteropolysaccharide-7 the optimum urea content of the water in which the polysaccharide is to be dissolved is not as high as for the undegraded heteropolysaccharide-7. From about ½% to about 5% urea in the water, by weight, is a preferred range of concentration regardless of the type of heteropolysaccharide-7, and the same concentration is suitable for other viscosity-increasing thickeners such as scleroglucan, mannan gum, etc. The increase in polysaccharide dissolution rate makes itself felt however, even with lesser concentrations of urea, and its effect is not changed much over wide variations in the amount of polysaccharide being dissolved.

The urea also helps reduce the freezing point of the concentrate. As little as ½% urea based on the weight of the concentrate produces a noticeable improvement, particularly when the concentrate also contains at least about 2% of a glycol or an etherified glycol freezing point depressant.

The urea can be partially or completely replaced by thiourea or even ammonium thiocyanate or ammonium cyanate, without much change in effectiveness. All of these additives rapidly dissolve in water to greatly improve its solvent action on the polysaccharide, even when the additive and the polysaccharide are added to the water simultanteously. The stabilizing effect of urea as noted in German Auslegseschrift No. 1,169,302 for protein hydrolyzates, is not noticeable with the polysaccharides of the present invention.

The diethylene glycol monobutyl ether in the above examples can also be omitted, although it helps boost the expansion obtainable when the concentrate is foamed, and also helps shorten the time required to extinguish a fire, particularly on hydrophilic liquids. Only about 2 to 5% of such additive based on the total weight of the concentrate is all that is needed for this purpose. This additive also helps reduce the freezing point of the concentrate, but this is not important. The concentrates of the present invention are freeze-thaw stable so that they are not damaged by freezing, and as they cool to freezing temperature their gelled condition becomes too stiff before they actually freeze. They should accordingly be stored for use at temperatures no lower than about 35° F., unless the concentrates are to be pumped through a diluting apparatus by a positive displacement pump.

It will be further noted that the dissolved magnesium salt significantly reduces the freezing point of the concentrates, whether or not other freeze-preventing additives are used. Additives such as ethylene glycol and hexylene glycol can be used in place of some or all of the diethylene glycol monobutyl ether, if desired, but are not preferred inasmuch as they are considered toxic to marine life fire-fighting liquids can eventually run off into streams.

The silicone surfactant and/or the fluorocarbon surfactant can also be omitted if desired. As noted in the parent applications, their presence makes the formulations, after dilution and foaming, extremely effective in extinguishing fires on hydrophobic liquids such as gasoline, so that these formulations can be used for fighting fires involving either type of liquid with excellent results. The silicone surfactant and the fluorocarbon surfactant cause aqueous films to form over burning hydrophobic liquids, and this greatly assists the fighting of fires on such liquids. However, either of these two aqueous film formers can be reduced in quantity or entirely eliminated, and good aqueous film formation generally effected by increasing the concentration of the other. Also as pointed out in the parent applications other fluorocarbon surfactants and other silicone surfactants can be used to provide the aqueous film formation. For such result the diluted concentrate should have a surface tension of 19 or less dynes per centimeter, preferably 18 dynes or less. Higher surface tensions do not cause significant aqueous film formation.

The omission of all fluorocarbon surfactant from the foregoing formulations also lowers the effectiveness with which they fight fires on hydrophilic liquids. At least about 0.03% fluorocarbon surfactant, or better still 0.05% is particularly desired to give such increased effectiveness to the diluted concentrate. The undiluted concentrate can then have at least ten times these amounts.

The formulation of Example 2 with its relatively high concentration of thixotropic polysaccharide does a very good job of extinguishing fires on hydrophilic liquids, even when diluted with 16⅔ times its volume of fresh or sea water. On the other hand the formulation of Example 1 is best used when diluted with only about 10 times its volume of fresh or sea water.

The formulations of both examples do not include the resinous film-formers normally used in foam concentrates as described in the parent applications. Such film-formers can be added as for instance in concentrations that add about ½% to about 1½% solids based on the total weight of the concentrate. A particularly good resinous film-former is the reaction product of 3-dimethylaminopropylamine-1 with an equivalent amount of ethylene-maleicanhydride copolymer, described in Example I of British Pat. No. 1,381,953.

The chlorinated metaxylenol of the formulations of the present examples is a biocide that prevents the growth of mold, bacteria, etc. in the concentrates. Other biocides or preservatives, such as methyl parahydroxybenzoate or any of those designated in the prior applications can be used instead of or combined with the chlorinated metaxylenol, preferably in a total concentration of 0.01 to about 0.03% by weight of the concentrate. When the concentrate is made by a sequence of steps extending over a number of hours, as for instance when the polysaccharide solution in the water is prepared and stirred or permitted to stand overnight before the remaining ingredients are added, the preservative should be added in the first stage of the preparation.

It will be noted that the formulations of Examples 1 and 2 not only have fluorocarbon and silicone surfactants in small amounts but they also have additional surfactants that are not of the fluorocarbon or silicone types and are in larger amounts to impart the desired foamability to the compositions. Those foamability-improving surfactants are largely of the type that have a hydrophilic moiety weighing at least 80% more than the lipophilic moiety, and thus follow the teachings of parent application Ser. No. 254,404.

The foamed compositions of the present invention do a very good job of extinguishing fires when applied by projection from foam-delivering nozzles, either portable or fixed as for example on towers, or from line-proportioning foamers, or foam chambers. In each case standard equipment can be used without modification.

The formulation of Example 2 meets all commercial standards when used to extinguish fires after dilution with 16⅔ times its volume of fresh or sea water, which is a standard dilution provided by standard foaming equipment. At this dilution it is preferred to apply it to fires on the following liquids as the designated rates in gallons of diluted liquid per minute per square foot of surface on the burning liquid, using a fixed applicator such as a foam chamber:

| | |
|---|---|
| Methanol | .16 |
| Isopropanol | .20 |
| n-Propanol | .10 |
| n-Butanol | .10 |
| t-Butyl Alcohol | .35 |
| Isodecanol | .10 |
| SDA-1-200 PF (Ethanol) | .16 |
| Ethyl Acetate | .10 |
| n-Propyl Acetate | .10 |
| Butyl Acetate | .10 |
| Methyl Amyl Acetate | .10 |
| Methyl Acrylate | .10 |
| Acetone | .20 |
| Methyl Ethyl Ketone | .20 |
| Methyl Isobutyl Ketone | .10 |
| Propionaldehyde | .10 |
| Hexane | .10 |
| Heptane | .10 |
| Automotive Gasoline | .10 |
| Lactol Spirits (Naphtha Solvent) | .10 |
| Mineral Spirits (Petroleum Spirit) | .10 |
| Toluene | .10 |
| Petroleum Distillate | .10 |
| Methyl Cellosolve | .10 |

The foregoing application rates are preferably increased by about one-fourth when using movable discharge nozzles to spread the applied foam and speed the extinguishment. However, it is not desirable to increase the rate of application to t-buty alcohol (on which fires are always difficult to extinguish) or to have a movable nozzle application rate less than about 0.16 gallons per minute per square foot.

The formulations of Examples 1 and 2 can be applied when diluted with 10 times their volume of fresh or sea water. The preferred application rates of the Example 2 formulation when so diluted are about one-fifth less than listed above, except that application rates lower than about 0.10 gallons per minute per square foot are not desirable whether from fixed or movable foam applicators. Also the tenfold dilution is not recommended for fires on hydrophobic liquids where the 16⅔ dilution has been a time-honored and widespread standard proven to be highly effective and built into standard fire-fighting equipment.

The formulations of the present invention can be further varied. Thus the formulation of Example 2 can use the fluorinated surfacant of Example 1, or major variations can be made such as shown in the following exemplifications:

EXAMPLE 3

In this example some of the heteropolysaccharide-7 is replaced by xanthan gum and good results are obtained, although there is some loss of burnback resistance. The formulation is

| | | |
|---|---|---|
| water | 6155 | mls. |
| urea | 62 | g. |
| the degraded heteropolysaccharide-7 of Example 2 | 41 | g. |
| xanthan gum | 41 | g. |
| o-phenoxy phenol | 5.8 | g. |
| the $C_9$ substituted imidazoline surfactant solution of Example 1 | 460 | mls. |
| the mixed alcohol sulfates solution of Example 1 | 530 | mls. |
| the silicone surfactant solution of Example 1 | 142 | mls. |
| the fluorinated surfactant of Example 1 | 68 | g. |
| acetic acid | 35 | mls. |

The formulation of Example 3 can also be modified by the addition of 0.3% tris-hydroxymethyl aminomethane, about 0.7% of the disodium salt of nitrilotriacetic acid, and about 3% butyl carbitol, based on the total weight of concentrate.

Other very effective mixtures of perfluorocarboxylic acids useful for the formulations of the present invention, are those in which by weight about 55 to about 70% is $C_8$, about 14 to about 23% is $C_{10}$, about 6 to about 9% is $C_{12}$, about 2 to about 7% is $C_{14}$, and any balance is $C_6$. Such a mixture in a concentration of 30 grams/gallon in a formulation also having 25 grams/gallon of the silicone surfactant solution of Example 1 and 600 mls./gallon of the mixed imidazolines of Example 1, 150 mls./gallon of 30% solution of the corresponding $C_{11}$-substituted imidazoline surfactant, 295 mls./gallon of propylene glycol monobutyl ether and 268 mls./gallon of butyl cellosolve, makes a very effective fire extinguisher whether or not the heteropolysaccharide-7 is added to it.

Instead of degrading the normal polymeric chains of heteropolysaccharide-7 their formation by fermentation can be stopped when it has proceeded about half to three-quarters the extent practiced to produce the undegraded heteropolysaccharide-7. This early termination lowers the yield but also produces a shorter polymer that can be considered a degraded form of heteropolysaccharide-7 in accordance with the present invention. The undegraded polymer seems to resist degradation by high-shear stirring.

The degree of chain-shortening is best determined by measuring the viscosity of aqueous solutions of the chain-shortened material. A 20° C. viscosity of over 3,000 centipoises for a 10% solution measured at 60 rpm of a number 4 spindle in a Brookfield viscometer, shows inadequate chain-shortening. Conducting the chain-shortening on a 1% solution of the polysaccharide permits convenient measurement of the viscosity as the chain-shortening reaction is taking place.

As shown, non-thixotropic thickeners for aqueous systems can also be used in amounts up to about half the total thickeners in the formulations of the present invention. Thus, locust bean gum can be used in an amount about ⅓ that of the thixotropic polysaccharide. Some thickeners such as guar gum and its derivatives impart to the concentrates a freeze-thaw instability that is not desired.

Special solvents such as the N-methyl pyrrolidone-2 of the parent application are not needed in the formulations of the present invention, so that these formulations are inexpensive to manufacture. Moreover N-methyl pyrrolidine-2 has an adverse effect on fire fighting with heteropolysaccharide-7 or its degraded forms. However, such solvents can be used in small amounts, e.g. up to about 10% by weight, to further reduce the viscosity of the concentrate.

It is helpful to buffer the concentrate as by the addition of some tris-hydroxymethyl aminomethane in a quantity of ⅛ to ½% by weight, unless the silicone surfactant is omitted.

The concentrates of the present invention can be stored in mild steel containers that have their interiors uncoated, or in plastic containers. No serious corrosion of the mild steel is produced after many months of storage in such a container. They can be used very effectively to fight non-polar liquid fires in tanks by introducing the foamed diluted concentrate below the liquid surface in the tank. This so-called sub-surface introduction technique is particularly desirable in tanks of gasoline or other petroleum products, and is not suitable for fighting fires on polar, that is hydrophilic, liquids.

Obviously many modifications and variations of the present invention are possible in the light of the above teachings. It is, therefore, to be understood that within the scope of the appended claims the invention may be practiced otherwise than as specifically described.

What is claimed is:

1. An aqueous pumpable fire-fighting concentrate for dilution with at least about ten times its volume of water and foaming with air to produce a fire-fighting foam having an expansion of at least about 3, the concentrate consisting essentially of water having dissolved therein a foaming agent that provides the foamability, and a thixotropic polysaccharide thickener that increases the Brookfield spindle 4 viscosity of the concentrate at 20° C. to not over about 3,000 centipoises at 60 rpm spindle speed and causes the fire-fighting foam to form an insoluble gel blanket when placed on a burning hydrophilic liquid, the concentration of the thickener in the concentrate being at least about 1% by weight.

2. The concentrate of claim 1 in which the polysaccharide is a degraded heteropolysaccharide-7.

3. The process of fighting a fire on a body of hydrophilic liquid, which process comprises applying to the burning surface of that liquid a foam having an expansion of at least about 3 foamed from an aqueous solution of a foaming agent and thixotropic polysaccharide selected from the class consisting of heteropolysaccharide-7 and degraded forms of heteropolysaccharide-7, the polysaccharide being dissolved in that solution in an amount that causes the foam to form a gel blanket when it contacts the hydrophilic liquid, and the solution being essentially in sea water.

4. The concentrate of claim 1 in which the concentration of the polysaccharide is over 1.1% by weight.

5. The concentrate of claim 1 in which the polysaccharide is selectd from the class consisting of heteropolysaccharide-7 and degraded forms of heteropolysaccharide-7, and the concentrate also contains magnesium sulfate dissolved in a proportion at least about 1/6 the weight of the polysaccharide and sufficient to improve the fire-fighting effectiveness of the concentrate when it is diluted with fresh water.

* * * * *

UNITED STATES PATENT AND TRADEMARK OFFICE

CERTIFICATE OF CORRECTION

PATENT NO. : 4,149,599

DATED : April 17, 1979

INVENTOR(S) : Peter J. Chiesa, Jr.

It is certified that error appears in the above-identified patent and that said Letters Patent are hereby corrected as shown below:

In the Abstract, line 1, "effecting" should be --effective--.

Col. 1, line 57, "dilute" should be --diluted--.

Col. 2, line numbered 59, "heterpolysaccharide-7" should be --heteropolysaccharide-7--.

Col. 3, line 4, "Uner" should be --Under--.

Col. 3, line numbered 44, "polysacchride" should be --polysaccharide--.

Col. 3, last line, "polysacchride" should be --polysaccharide--.

Col. 4, line numbered 45, "effectively" should be --effective--.

Col. 5, line 64, --and-- should be inserted after "life".

Col. 7, line numbered 42, "t-buty" should be --t-butyl--.

Col. 8, line numbered 18, "0.7%" should be --0.07%--.

Signed and Sealed this

*Seventh* Day of *August 1979*

[SEAL]

*Attest:*

*Attesting Officer*

LUTRELLE F. PARKER

*Acting Commissioner of Patents and Trademarks*